US005222683A

United States Patent [19]

Blackshire

[11] Patent Number: 5,222,683

[45] Date of Patent: Jun. 29, 1993

[54] WIRE DISPENSING APPARATUS

[76] Inventor: Glen M. Blackshire, 626 Martinshire, Carson, Calif. 90745

[21] Appl. No.: 883,524

[22] Filed: May 15, 1992

[51] Int. Cl.[5] ..... B65H 49/18

[52] U.S. Cl. ..... 242/137.1; 242/129; 242/138; 242/146

[58] Field of Search ..... 242/129, 129.5, 129.6, 242/129.62, 130, 132, 134, 137, 137.1, 138, 146, 86.5 R

[56] References Cited

U.S. PATENT DOCUMENTS

| | | | |
|---|---|---|---|
| 1,099,766 | 6/1914 | Prince | 242/137 |
| 1,476,778 | 12/1923 | Tate | 242/129.62 |
| 1,483,729 | 2/1924 | Isted | 242/138 |
| 1,541,562 | 6/1925 | Gilbert et al. | 242/146 |
| 1,569,577 | 1/1926 | Robinson | 242/138 |
| 1,726,137 | 8/1929 | Bernal | 242/86.5 R |
| 2,554,615 | 5/1951 | Dahle | 242/146 |
| 2,954,942 | 10/1960 | LaRaus | 242/129 |
| 2,965,331 | 12/1960 | Nagy | 242/138 |
| 3,284,025 | 11/1966 | Fridolph | 242/137 |
| 3,680,810 | 8/1972 | Jarmalow | 242/146 X |
| 3,819,847 | 6/1947 | Charles | 242/129 X |
| 4,015,795 | 4/1977 | Chong | 242/129 X |
| 4,089,486 | 5/1978 | Carter | 242/129 |
| 4,826,100 | 5/1989 | Belliveau | 242/129 |
| 4,909,457 | 3/1990 | Johnson | 242/146 X |

FOREIGN PATENT DOCUMENTS

| | | | |
|---|---|---|---|
| 720109 | 12/1954 | United Kingdom | 242/146 |

*Primary Examiner*—Stanley N. Gilreath
*Attorney, Agent, or Firm*—Robert J. Schaap

[57] ABSTRACT

A wire dispensing apparatus which comprises a housing adapted to receive a spool or coil of electrical wire. In one embodiment, the wire dispensing apparatus comprises a housing which is provided with a cylindrically-shaped container sized to receive spools of wire. One end of the wire is trained through an elongate slot on the housing so that the wire may be pulled from the spool through the elongate slot. The housing may be designed to mount on a conventional wire rack or so-called caddie. In another embodiment, the housing may be constructed in the form of a suitcase in which a plurality of different spools of wire may be located and which is provided with elongate slots for pulling coils of wire therefrom. The device is also capable of dispensing heavy insulated wire, such as Romex or the like.

3 Claims, 4 Drawing Sheets

WIRE DISPENSING APPARATUS

BACKGROUND OF THE INVENTION

1. Field of the Invention

This invention relates in general to certain new and useful improvements in wire dispensing apparatus, and more particularly, a wire dispensing apparatus in which wires from spools or unspooled coils may be dispensed without causing excess removal of the wire from the spool or coils during demand thereof.

2. Brief Description of the Prior Art

Electricians are commonly required to carry a number of different types of spools of electrical wire. In wiring of an installation as, for example, in a building, many different gauges of electrical wire may be required and furthermore, wires may be color coded for different applications or connections. Usually, the spools of electrical wire are carried on racks or so-called "wire caddies" containing elongate rods for holding the center cores of wire spools. The wire caddies are designed so that they will removably hold a plurality of spools of wire so that the wire may be dispensed from the spool. However, while these wire racks are effective for transporting a plurality of spools to a given work location, they are not designed to overcome the problem "overspooling", that is, pulling an excess of wire from the spool upon demand thereof.

Where there is demand for electrical wire at a given work station, the electrician pulls wire from the spool. If excess force is used, wire will start pulling from the spool and overflow the end plates of the spool and become wound about the rod forming part of the wire rack. When the wire overflows the end plates and spools or coils on the fixed support rod, a capstan effect is created and it is necessary for the electrician to immediately stop gainful work and unwind the coiled wire on this fixed rod forming part of the wire rack and which results in unproductive downtime.

Another one of the problems commonly encountered with conventional wire racks is that the wire cannot be removed from the spool in any direction except one almost perpendicular to the spool. Otherwise, excess turns of wire will become unwound from the spool and again, become wound upon the support rod of the wire rack. Thus, if the electrician is working at a location where the wire would not be pulled in a direction substantially perpendicular to the axis of the spool, the electrician must stop the electrical wiring activity and reposition the wire rack. Moreover, each time that the electrician moves to another location, it is necessary to reposition the wire rack in order to avoid the same problem.

Electrical signal-containing wire, such as telephone wire, intercom wire and the like, is often supplied in prewound coils contained within a paperboard box. The electrician, or other user of the electrical wire of this type, merely opens a generally circular hole in the upper lid of the box along a preformed score line. A loose end of the wire is then pulled from this box in this fashion. However, the pulling of the wire in this fashion can easily result in the formation of knots in the line. When this occurs, it is almost necessary to tear the box open and remove the knot from the strand of wire, thereby effectively destroying the box for its intended purposes.

Heretofore, there has not been any wire dispensing apparatus which is effective for unspooling wire without the resultant overspooling thereof. In addition, there has not been any effective wire dispensing apparatus which permits a dispensing of wire in essentially any direction with respect to the axis of a spool of wire.

In addition to the above, there is essentially no effective mechanism whatsoever for dispensing thick gauged wire which is relatively unspoolable, that is, wire usually having a relatively thick insulation layer thereon. Wire of this type is often commercially available under the name "Romex." The same type of device which is capable of unspooling lower gauged wire is also needed for the unspooling of heavy gauged or heavy insulated wire.

OBJECTS OF THE INVENTION

It is, therefore, one of the primary objects of the present invention to provide a wire dispensing apparatus which is capable of enabling the dispensing of wire therefrom upon demand without the resultant problem of overspooling or causing the unspooled wire to wind about a fixed support.

It is another object of the present invention to provide a wire dispensing apparatus of the type stated which is designed so that wire may be dispensed from the apparatus from any angular position with respect to the wire dispensing apparatus.

It is a further object of the present invention to provide a wire dispensing apparatus of the type stated which is capable of receiving conventional spools of electrical wire and which does not necessitate the removal of the wire from the spool in order to be dispensed from the apparatus.

It is an additional object of the present invention to provide a wire dispensing apparatus of the type stated which is relatively simple in construction and therefore, highly reliable in operation.

It is another salient object of the present invention to provide a wire dispensing apparatus of the type stated which can be constructed in a variety of forms, but which are all economically feasible for operation and use.

With the above and other objects in view, my invention resides in the novel features of form, construction, arrangement and combination of parts presently described and pointed out in the claims.

BRIEF SUMMARY OF THE DISCLOSURE

A wire dispensing apparatus of the type which is capable of dispensing electrical wire therefrom and which may be used with, or on, conventional wire racks or so-called "wire caddies." The dispensing apparatus may also be made in the form of a stand-alone unit where a rack or caddie is not required.

The wire dispensing apparatus of the invention has several purposes, and one of the more important purposes is to permit the unspooling of wire from a spool or a coil upon demand without overspooling thereof. Generally, the term "overspooling" relates to the pulling of wire from a spool at a rate which causes a dispensing of an excess amount of wire and which permits the spool to rotate, as a result of centrifical force applied to the spool after the demand amount of wire has been pulled.

When an excess of wire is pulled from a spool during the unspooling of wire, the excess of wire usually wraps about the support rod on the wire rack which holds the spool. As this occurs, and when the wire is wound about a fixed axis of rotation, a capstan effect is created whereby it becomes extremely difficult, if not virtually impossible, to pull additional wire from the spool without unwinding the wire from the rod of the support rack.

Another problem which has been overcome by the wire support rack of the present invention is that wire can be pulled from a spool or a coil at virtually any demand angle relative to the axis of rotation of the spool or coil. Heretofore, it was virtually impossible to pull electrical wire from a spool or a coil of that wire at an angle other than perpendicular to the axis of rotation of the coil or spool. Moreover, it was virtually impossible to pull wire in a direction other than pulling the wire in a relatively straight line from the surface of the spool.

The term "electrical wire", as used herein, is used in a broad sense to encompass all forms of electrical wire which are capable of transmitting any form of electrical signal, whether that signal be in the form of 110 volt current, 6 volt electrical current or, for that matter, millivolt signals. Thus, the term "electrical wire" will include, for example, speaker wire, intercom wire, alarm system wire, telephone wire, etc. and generally any wire which is designated to carry an electrical signal and employs an insulating sheath on the exterior thereof.

The wire dispensing apparatus of the present invention in one embodiment comprises an outer housing which is capable of receiving a conventional spool of electrical wire. In this embodiment, an opening is provided in a cylindrically-shaped side wall of a cylindrically-shaped housing forming part of this apparatus and which opening is sized to receive a conventional spool of electrical wire. An elongate slot, essentially parallel to the axis of rotation of the spool, is provided in the housing to receive an end of the wire. In this way, electrical wire on a spool may be inserted in a cylindrically-shaped housing which has a side wall closely spaced to the circumferential periphery of the wire spool.

When wire is pulled through the elongate slot, it is allowed to unwind from the spool. However, since the spool is closely captured in the housing, continued rotation of the spool after the demand amount of wire has been pulled from the spool, is virtually precluded. As a result, there is no overspooling thereof. In addition, wire is precluded from unwinding over the end plates of the wire spool so that the resultant winding about a support rod supporting the wire spool is prevented. In addition, since the wire is being pulled through the elongate slot, and since the wire spool is held in a controlled environment, the wire can be pulled from the spool at virtually any direction relative to the axis of rotation of the spool.

In another embodiment of the invention, the housing may be provided in or form part of a carriable case, such as a briefcase or the like. The housing, in this embodiment, will still have a cylindrically-shaped side wall, even though it may be formed of a pair of inserts located in the two shells of a suitcase or briefcase. An elongate slot is formed in one wall of a shell of the suitcase in order to permit the threading of the wire and to enable the pulling of the wire from the spools and from the interior of the suitcase or briefcase. Further, a plurality of housings could be formed in a single carrying case, such as a briefcase or suitcase, so that a plurality of individual types of wires may be dispensed therefrom.

The present invention also provides a wire dispensing apparatus which is capable of dispensing a heavy insulated wire such as Romex or the like. Romex or other heavy insulated wire usually possesses very little flexibility and is not readily unspooled or uncoiled from a spool or coils thereof. The apparatus of the invention readily allows unspooling or uncoiling of such heavy wire retained within a housing of the invention.

The housing for the heavy insulated wire is one which will retain the coil or spool about its central axis of rotation. Furthermore, it can be constructed so that the Romex or other heavy insulated wire can be transported in a carrying case as, for example, a briefcase or suitcase. The housing is formed with a cylindrically-shaped side wall and carries a rotatable tray which receives the coils of wire. The wire is pulled through an elongate slot in the carrying case so that the wire may be pulled at a direction tangential to the outer surface of the coil of heavy insulated wire.

The present invention has many other advantages and purposes which will become more fully apparent from a consideration of the forms in which it may be embodied. Several of these forms are illustrated in the accompanying drawings and described in the following detailed description of the invention. However, it should be understood that the accompanying drawings and this detailed description are only for purposes of setting forth the general principles of the invention and are not to be taken in a limiting sense.

BRIEF DESCRIPTION OF THE DRAWINGS

Figure 1:
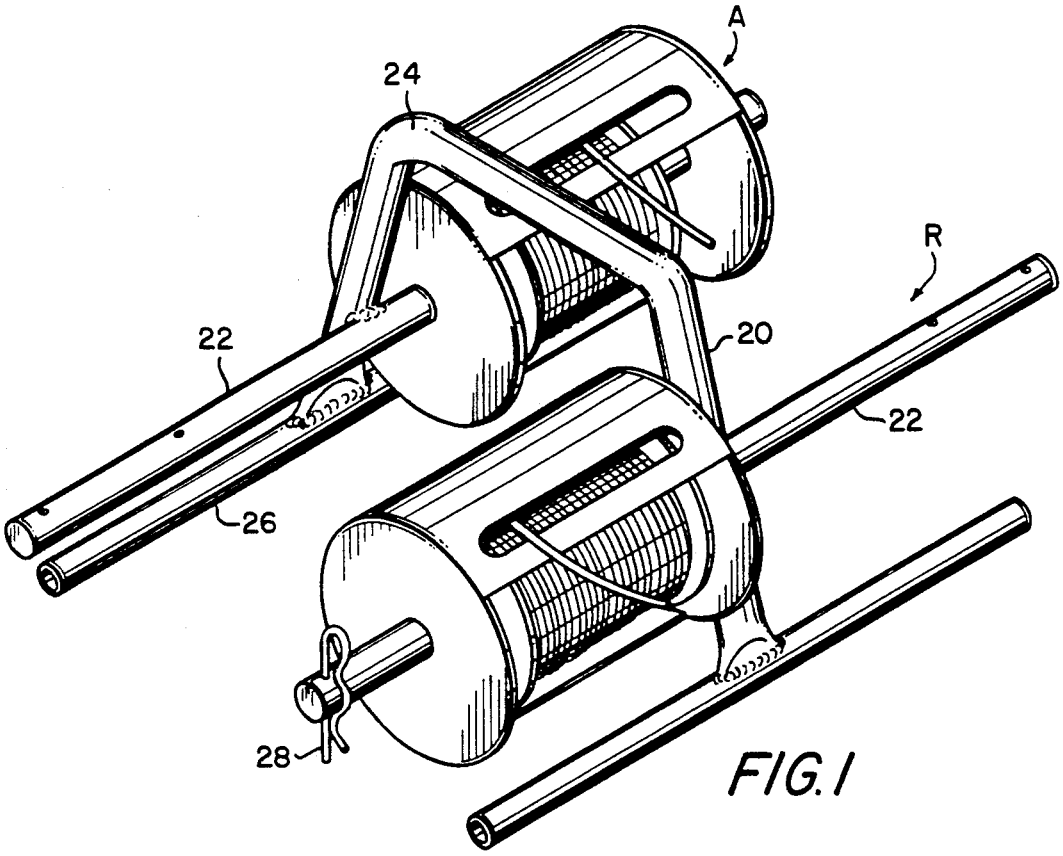
Figure 2:
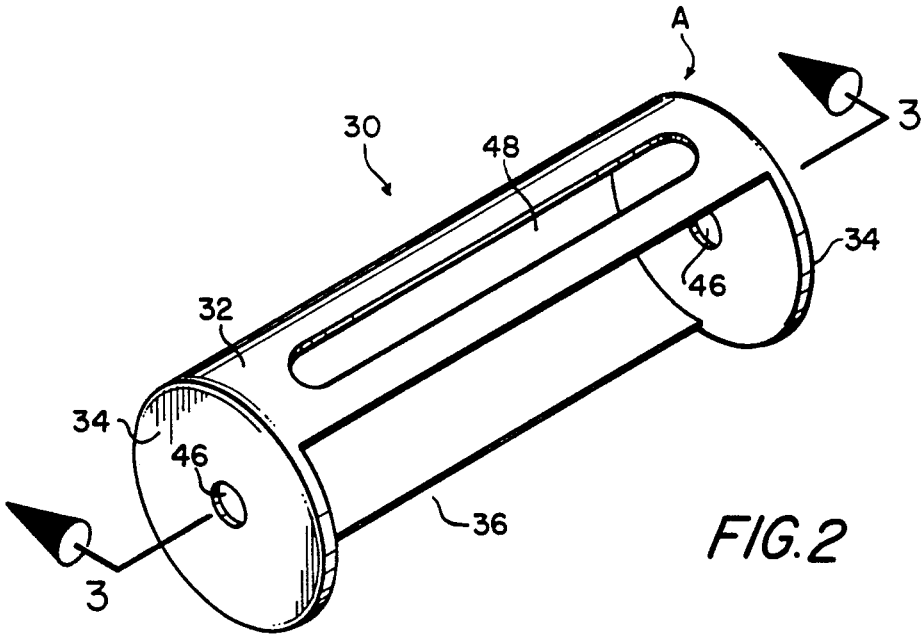
Figure 3:
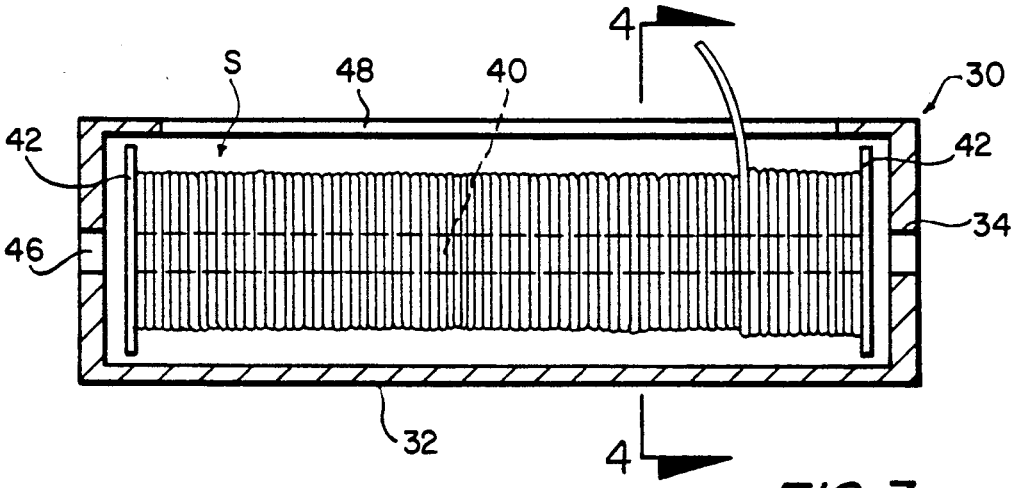
Figure 4:
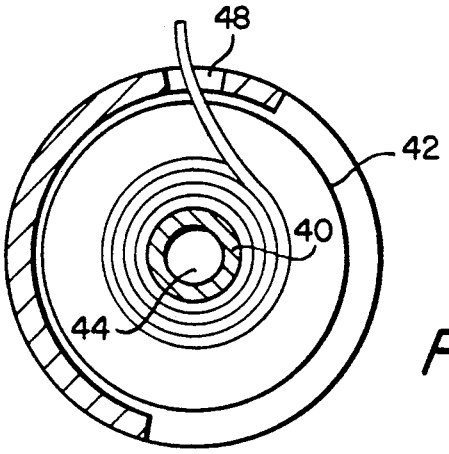
Figure 5:
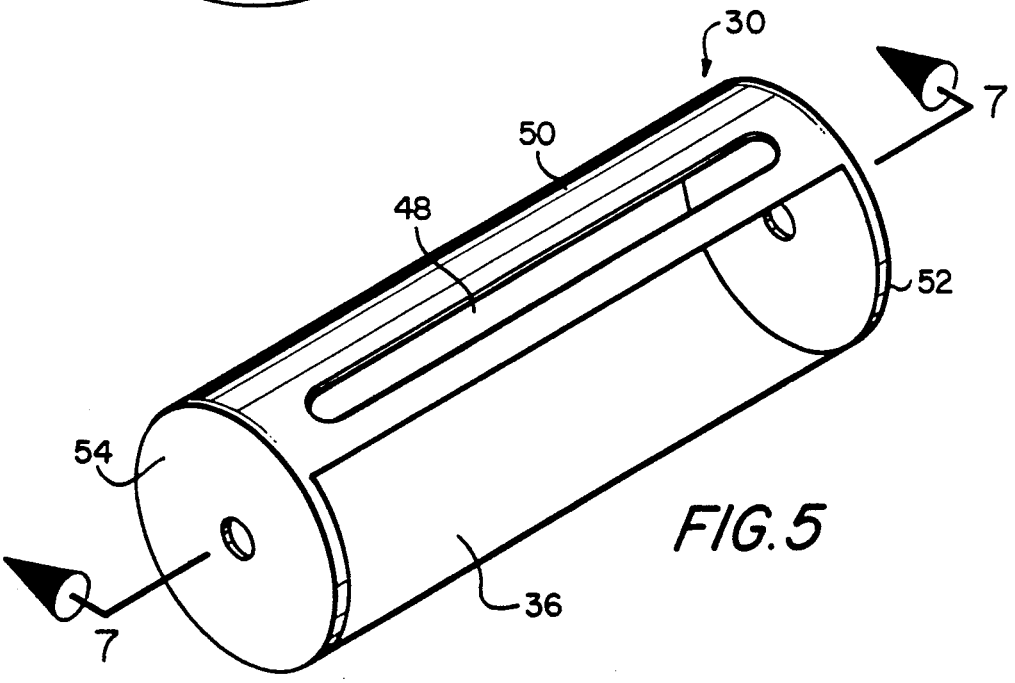
Figure 6:
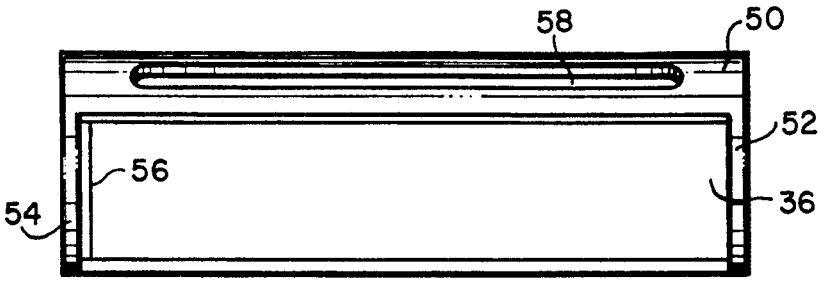
Figure 7:
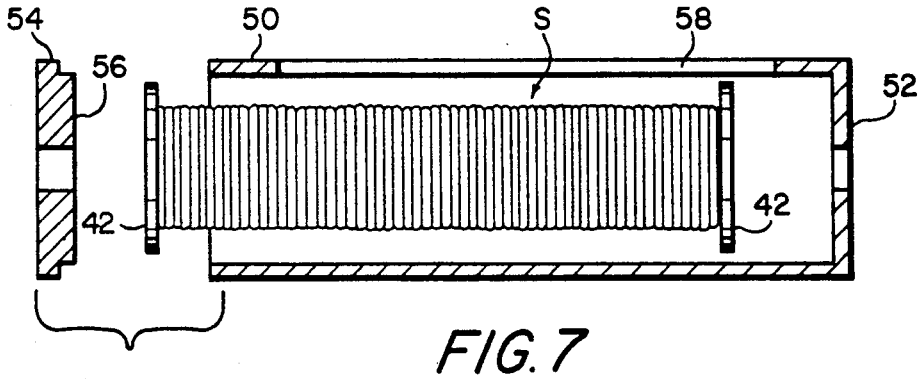
Figure 8:
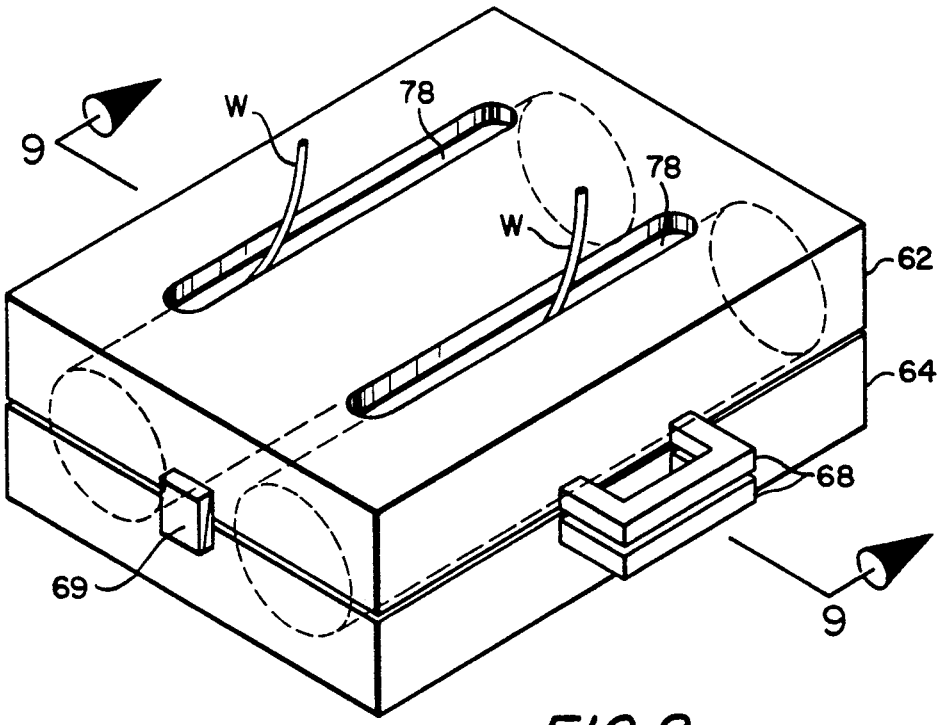
Figure 9:
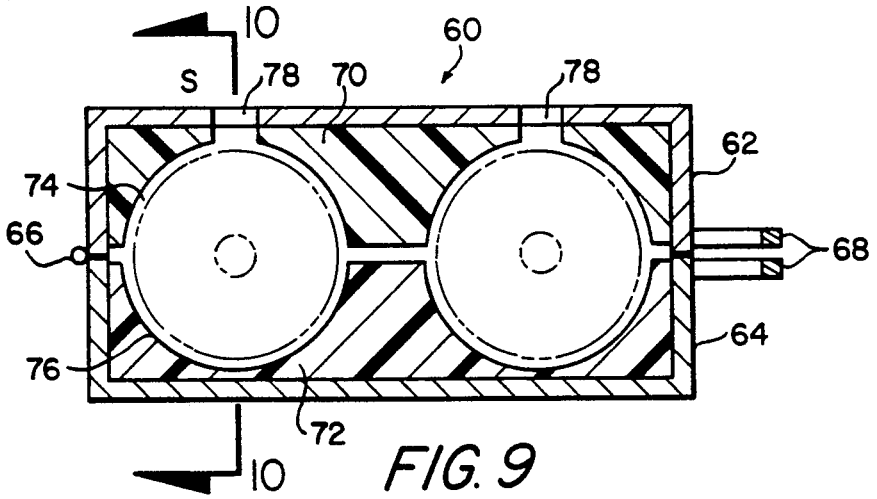
Figure 10:
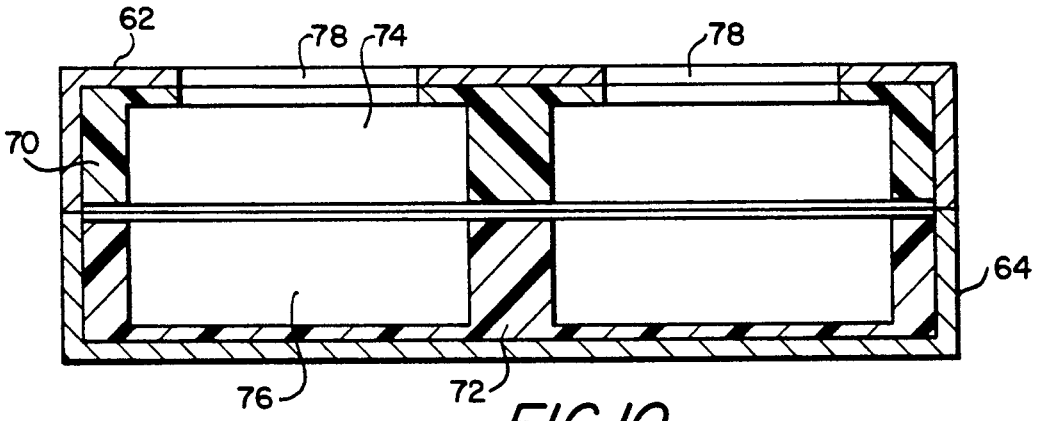
Figure 11:
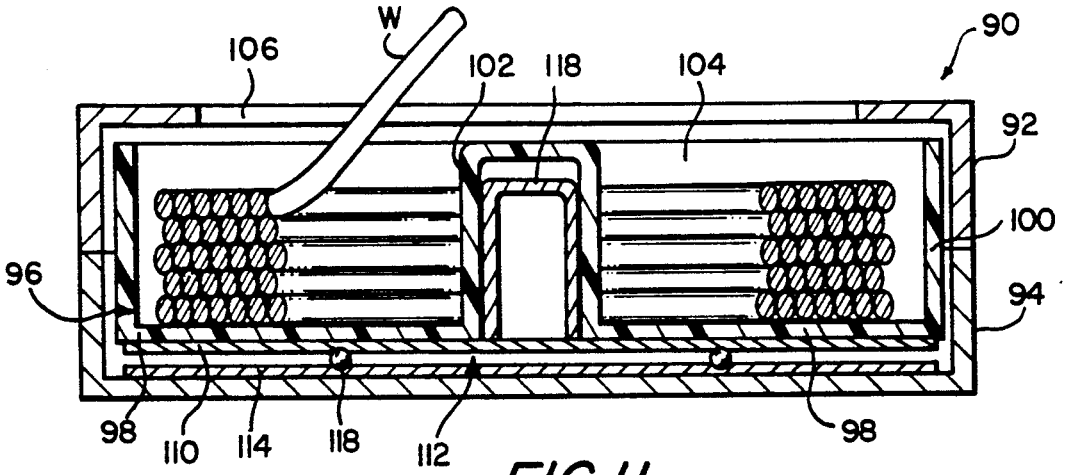

Having thus described the invention in general terms, reference will now be made to the accompany drawings (four sheets) in which:

FIG. 1 is a perspective view of a wire dispensing apparatus constructed in accordance with and embodying the present invention and disposed on a convention wire rack;

FIG. 2 is an enlarged perspective view of the wire dispensing apparatus of FIG. 1;

FIG. 3 is a vertical sectional view taken along line 3—3 of FIG. 2 and showing a spool of wire in a housing forming part of the wire dispensing apparatus;

FIG. 4 is a vertical sectional view taken along line 4—4 of FIG. 3;

FIG. 5 is a perspective view of a modified form of wire dispensing apparatus;

FIG. 6 is a front elevational view of the modified form of wire dispensing apparatus;

FIG. 7 is an exploded vertical sectional view taken substantially along line 7—7 of FIG. 5;

FIG. 8 is a perspective view of another modified form of wire dispensing apparatus in the form of a carrying case;

FIG. 9 is a vertical sectional view taken along line 9—9 of FIG. 8;

FIG. 10 is a vertical sectional view taken along line 10—10 of FIG. 9; and FIG. 11 is a vertical sectional view of a further modified form of wire dispensing apparatus.

DETAILED DESCRIPTION OF PREFERRED EMBODIMENTS

Referring now in more detail and by reference characters the drawings which illustrate several practical embodiments of the present invention, A designates a wire dispensing apparatus of the invention which is shown as being removably disposed on a conventional wire rack or so-called "wire caddie." In order to understand the overall use of the wire dispensing apparatus of this invention on the rack or caddie, a brief description of a conventional wire rack R is set forth.

The conventional wire rack R is comprised of a main inverted, somewhat U-shaped center frame 20, in the nature of a hoop, having a plurality of wire spool support rods 22 extending outwardly therefrom. The hoop or center frame 20 may also be conventionally provided with a handle, or otherwise the bight portion 24 may serve as a handle 24, as best illustrated in FIG. 1 of the drawings. A pair of elongate legs 26 on each of the opposite sides of the center frame 20 are also provided for resting or supporting the wire rack on a relatively flat surface. The wire spools may be conventionally held on the rods 22 by cotter pins 28.

FIG. 1 illustrates one wire dispensing apparatus of the invention mounted on the wire rack R. However, the wire rack R is designed to retain either four large length spools, e.g. one on each rod 22, or eight small length spools of wire, e.g. two on each rod 22. In like manner, either four elongate length wire dispensing apparatus of the invention or eight short wire dispensing apparatus of the invention may be mounted on this conventional wire rack.

The wire dispensing apparatus A comprises an outer housing 30 which has a semi-hemispherically shaped outer side wall 32 and a pair of circularly shaped end walls 34 at each of the opposite ends thereof. By reference to FIGS. 1, 2 and 4 of the drawings, it can be observed that the housing 30 is effectively provided with a semi-hemispherically shaped access opening 36. Accordingly, the side wall 32 extends for an arc of approximately 180 degrees and the opening 36 extends for an arc of approximately 180 degrees.

The housing 30 is designed to removably receive a wire-containing spool S upon which is wound a suitable electrical wire W. The wire-containing spool S is generally comprised of a central elongate tube 40 having a pair of enlarged end retaining plates 42. In addition, the end retaining plates 42 are provided with central openings which communicate with the interior of the tube 40 forming an elongate axially extending opening 44. This construction allows the spool to be retained on a conventional wire rack R.

In a more preferred embodiment of the invention, the end plates 42, forming part of the spool S, are closely spaced with respect to the end walls 34 of the housing. Furthermore, the annular peripheral edges of the end retaining plates 42 are only slightly spaced from the interior surface of the semi-cylindrical side wall 32. The end walls 34 of the housing are also provided with openings 46 which will align with the central opening 44 contained in the spool tube 40. In this way, the housing 30, along with a conventional wire spool disposed therein, can be journaled on one of the rods 22 of the wire rack R.

The housing 30 is also provided on the cylindrically-shaped side wall 32 with an elongate slot 48. By reference to FIGS. 3 and 4 of the drawings, it can be seen that a strand of wire W can be threaded through this elongate slot 48. The threading of the wire W through the elongate slot 48 will preclude the so-called "over-winding" which normally causes the wire to run over the end retaining plates 42 on the spool. In this case, however, the mere training of the wire W through the elongate slot 48 effectively precludes this over-winding. This is due to the fact that the spool itself is rotatably retained within the housing, but yet there is a sufficient slight amount of frictional force which can result such that pulling on the free end of the wire W will not cause a freewheeling or spinning of the wire-containing spool S. Furthermore, and inasmuch as the wire is pulled through the elongate slot 48, the wire can be pulled from substantially any direction with respect to the housing 30 and hence, the wire spool S. From the standpoint of the spool, the wire is still effectively being pulled at a direction generally perpendicular to the axis of the spool in a plane generally parallel to the surface of the wire on the spool.

The spool of wire can easily be loaded into, and unloaded from, the housing 30, due to the fact that the opening 36 is semi-cylindrical in shape. Further, one spool of wire can easily be inserted into and removed from the housing and a second spool of wire can be substituted therefor.

FIGS. 5–7 illustrate a slightly modified form of a wire dispensing apparatus which is constructed in accordance with and embodies the present invention. This wire dispensing apparatus also comprises an outer housing 30, except that the opening 36 has an arcuate shape which is less than 180 degrees. Thus, the cylindrical side wall will extend for an arcuate distance greater than 180 degrees. Due to the fact that the size of the opening in this embodiment is more limited, a different means for loading and unloading a wire spool is employed.

The wire dispensing mechanism of FIGS. 5–7 generally comprises the outer housing 30, but which has a cylindrically-shaped side wall 50, having only one end plate 52 integrally formed therewith or rigidly secured thereto. An opposite end cap or end plate 54 is also provided for disposition over the opposite open end of the housing 30 in this embodiment of the invention. In this case, the end cap 54 has an integrally formed, diametrally reduced hub 56 which sill snugly fit within the circularly-shaped, left-hand open end, reference being made to FIG. 7 of the drawings.

In accordance with the construction of the housing illustrated in FIGS. 5–7, it can be observe that a wire spool can be loaded from the left-hand end of the housing and, when fully loaded, the end plate 54 can be reinserted into the open end. In this way, if desired, it is possible to have a smaller front opening in the housing. The housing of FIGS. 5–7 also is provided with an elongate slot 58 equivalent to the elongate slot 48 for feeding of the wire in the same manner as previously described.

FIGS. 8–10 illustrate an embodiment of a wire dispensing apparatus which can be constructed in the form of a carrying case. In this embodiment, the wire dispensing apparatus comprises an outer case 60 in the nature of a suitcase or briefcase. This case 60 may be comprised of a pair of openable shells 62 and 64 which are hingedly connected to one another by a hinge mechanism 66 at its rear wall. A pair of handles 68 are provided at the front walls of the shells 62 and 64, in the manner as best illustrated in FIGS. 8 and 9 of the drawings. In this way, the user of the device can merely open one of the shells 62 relative to the other of the shells 64. If desired, a suitable locking mechanism or snap 69 may be provided in order to releasably lock the two shells in their closed position, as best illustrated in FIGS. 8–10 of the drawings.

The two shells 62 and 64 may be constructed of a fairly rigid durable material such as a reinforced plastic composite material. Metals such as aluminum or the like may also be employed for this purpose. Generally, construction used for lightweight suitcases and briefcases can also be used for the construction of this wire dispensing apparatus.

Each of the outer shells 62 and 64 are generally rectangular in shape, as best illustrated in FIGS. 9 and 10 of the drawings. Further, each define an interior cavity which retains a suitable foam plastic insert, such as the plastic inserts 70 and 72, respectively. These inserts 70 and 72 cooperate with one another and are each provided with semi-hemispherical recesses 74 and 76 which together form a hemispherical cylindrically shaped opening for receiving a wire spool, the latter of which is illustrated in dotted lines in FIG. 9.

The case 60 is constructed so that there is a pair of cylindrically shaped openings on each of the opposite sides. Moreover, the openings each have a length so as to enable accommodation of two or more wire spools S. The openings are also sized so that they have a diametral cross-sectional size substantially equivalent to that of the housing 30 in the previously described embodiment of the invention.

The upper insert 70 and the upper shells 62 are each provided with a pair of elongate slots 78 for threading wire W therethrough. In accordance with this construction, a user of the case 60 would open the shell 62 relative to the shell 64 and insert one or more wire spools S therein. The user would also thread the free ends of the wires W through the elongate slot 78. The operation of this wire dispensing device would therefore be similar to the operation of the previously described wire dispensing apparatus.

FIG. 11 illustrates an embodiment of the invention which is designed to receive and dispense wire with thick insulation, such as Romex cable or the like. In this embodiment, the wire dispensing apparatus comprises a housing 90 having an upper shell 92 and a lower shell 94 which are openable relative to one another, much in the same manner as the previous embodiment of the housing utilizing a pair of openable shells. Thus, since the housing 90 is substantially similar in construction to the housing 60, further details thereof are neither illustrated nor described in detail herein.

The housing 90 is provided with an insert 96 having a bottom wall 98 and an integrally formed upstanding peripheral side wall 100. Further, the insert 96 is integrally formed with a centrally located upstanding hub 102 forming a cylindrically shaped well 104 to receive the wire cable. In this embodiment, the heavy insulated wire conductor is laid in coils on the bottom wall 98 and effectively coiled about the center hub 102. The housing 90 is also provided with an elongate slot 106 in order to receive a wire strand W. However, the strand W is pulled from the top of the wire coil as laid horizontally in the housing in the manner as illustrated in FIG. 11.

The bottom wall 98 of the insert 96 rests upon a rotatable plate 110 forming part of a rotatable assembly 112. By further reference to FIG. 11, it can be observed that the rotatable assembly 112 includes a fixed bottom plate 114 and which rotatably supports the upper plate 110 by means of a ball bearing arrangement 116. In this way, the entire insert and the wire coils wrapped about the hub will rotate. In order to fixedly position the insert in a rotatable position about a fixed central axis, the upper plate 110 may also be provided with a upstanding center boss 118.

It can be observed that each of the embodiments of the wire dispensing apparatus allow wire to pass through the elongate slot when pulled outwardly from the housing. Close spacing of either the walls of the spool or the coils of loose wire, with respect to the walls of the housing, precludes an overspooling and, in effect, an over demand for the wire. In addition, this construction enables wire to be pulled at a direction generally perpendicular to the axis of the coils, regardless of the orientation of the wire with respect to the housing. In other words, an electrician may pull wire from the spool at an angle which is 90 degrees from the tangential plane as if the wire were pulled by someone standing directly in front of the spool of wire and pulling perpendicularly to the axis of the spool. In other words, one may pull wire in an axis almost parallel to the axis of the spool without creating any overwinding and without creating any improper unspooling of the wire.

Thus, there has been illustrated and described, a unique and novel wire dispensing apparatus, as well as an associated method, for withdrawing wire from coils thereof without overwinding and which enables pulling at substantially any angle with respect to the orientation of the axis of the coils. Thus, the present invention fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A wire dispensing apparatus for dispensing an individual strand of electrical wire from a coil of such electrical wire comprised of a plurality of turns of the wire wound on a spool, said device comprising:

a) a housing having a cylindrically shaped side wall and a pair of opposed end walls connected to said side wall and forming an interior chamber;

b) a pair of aligned holes in said opposed end walls to receive a shaft within said chamber and which extends axially through said chamber, said shaft being sized and located so that a spool of the wire is rotatably disposed about said shaft;

c) said shaft being removable from said aligned holes to receive a new spool and being reinsertable through the aligned holes and a central bore in the spool to removably retain the spool in the chamber;

d) said side wall having an enlarged semi-cylindrically shaped opening to provide access to and insertion of a spool of wire into the interior chamber to locate the spool of wire therein and to also remove the spool of wire therefrom without any disassembly of the housing;

e) said apparatus being positioned so that the central axis of the spool is generally horizontally located when wire is pulled outwardly from said housing; and f) an elongate slot for receiving a strand of wire which is uncoiled from the spool and through which the wire may be pulled outwardly from said housing, said slot extending from about end to end of the turns of wire on the spool and where the slot is generally horizontally disposed when the apparatus is positioned for use, said slot also being located so that wire is pulled from the upper surface of the coils of wire on the spool and which permits the wire to be unconvoluted from successive coils thereby allowing the wire to be pulled from the spool initially almost in a straight line generally perpendicular to the axis of the spool, such that the wire is pulled in such manner that there is no over-spooling of the wire and which also allows the wire to be pulled from essentially any direction with respect to the housing and where the wire being uncoiled is tangential to a circumference of the turns of the wire on the spool.

2. The wire dispensing apparatus of claim 1 further characterized in that said side wall has an interior wall surface which is somewhat cylindrically shaped and is closely spaced to the coils of wire on the spool.

3. The wire dispensing apparatus of claim 1 further characterized in that said shaft is a central shaft of a wire caddie and which is sized to hold a plurality of spools of wire.

* * * * *